US012727669B2

(12) United States Patent
Payne

(10) Patent No.: US 12,727,669 B2
(45) Date of Patent: Sep. 8, 2026

(54) LUGGAGE STORAGE BERTH DEVICE

(71) Applicant: Becky Payne, Atlanta, GA (US)

(72) Inventor: Becky Payne, Atlanta, GA (US)

( * ) Notice: Subject to any disclaimer, the term of this patent is extended or adjusted under 35 U.S.C. 154(b) by 0 days.

(21) Appl. No.: 18/430,654

(22) Filed: Feb. 2, 2024

(65) Prior Publication Data

US 2024/0164518 A1 May 23, 2024

(51) Int. Cl.

| | |
|---|---|
| ***A47B 81/00*** | (2006.01) |
| ***A47B 88/437*** | (2017.01) |
| ***A47B 88/50*** | (2017.01) |
| ***A47B 97/00*** | (2006.01) |

(52) U.S. Cl.

CPC ..... *A47B 81/00* (2013.01); *A47B 88/437* (2017.01); *A47B 88/50* (2017.01); *A47B 2097/008* (2013.01)

(58) Field of Classification Search

CPC ..... A47B 2097/008; A47B 88/50; A47B 2210/0086; A47B 63/00; A47B 63/02; A47B 67/04; E05B 65/462; E05B 65/463

See application file for complete search history.

(56) References Cited

U.S. PATENT DOCUMENTS 1,280,183 A * 10/1918 Donathan ..... E05B 65/464 312/221
1,533,831 A * 4/1925 Colchin ..... E05C 17/443 292/DIG. 15
1,728,946 A * 9/1929 Tobey ..... A47B 63/02 312/301
2,405,668 A * 8/1946 Paxton ..... A47B 96/16 312/273
2,941,847 A * 6/1960 Dargene ..... A47B 88/437 384/19
3,026,149 A * 3/1962 Ruhnke ..... A47B 88/437 384/19
3,354,878 A * 11/1967 Balls ..... F24C 1/16 126/275 R
3,446,545 A * 5/1969 Horlacher ..... A47B 88/41 312/334.42
4,492,418 A * 1/1985 Bailey ..... E05B 65/463 312/220
10,758,046 B1 * 9/2020 Stravitz ..... A47B 97/00

(Continued)

FOREIGN PATENT DOCUMENTS

EP 4257010 A1 * 10/2023 ..... A47B 43/00
JP 2008048841 A * 3/2008

*Primary Examiner* — Andrew Roersma

(57) ABSTRACT

A luggage storage berth device is provided which may utilize a top support substrate and a bottom support substrate. There may be a plurality of horizontal stabilization structures disposed between the top and bottom support substrates, a plurality of vertical stabilization structures disposed between the top and bottom support substrates, an outer berth body disposed between the top and bottom support substrates, a plurality of berth cavities defined in part by each of the top support substrate, the bottom support substrate, the plurality of horizontal stabilization structures, the plurality of vertical stabilization structures, and the outer berth body. The device may further comprise a plurality of storage trays such that each storage tray is disposed within a respective berth cavity, and each storage tray translates between a stowed configuration and an extended configuration.

20 Claims, 7 Drawing Sheets

(56) References Cited

U.S. PATENT DOCUMENTS

| | | | | |
|---|---|---|---|---|
| 11,684,157 | B1 * | 6/2023 | Stravitz | A47B 97/00<br>312/351.1 |
| 11,920,382 | B2 * | 3/2024 | Scalf | E05B 1/0015 |
| 2013/0127316 | A1 * | 5/2013 | Wu | A47B 88/9416<br>312/258 |
| 2015/0201755 | A1 * | 7/2015 | Moon | A47B 47/0075<br>211/153 |
| 2018/0263369 | A1 * | 9/2018 | Chen | A47B 88/45 |
| 2021/0227976 | A1 * | 7/2021 | Orsini | A47B 96/00 |
| 2022/0025671 | A1 * | 1/2022 | North | F16M 13/00 |
| 2022/0192374 | A1 * | 6/2022 | Haynes, Sr. | A61M 16/021 |

* cited by examiner

LUGGAGE STORAGE BERTH DEVICE

BACKGROUND OF THE INVENTION

The realm of luggage storage, especially in transient living environments such as hotels, Airbnbs, and similar accommodations, has long been a subject of convenience and efficiency. Traditional approaches to luggage storage have predominantly involved either leaving luggage in a suitcase, typically placed on a luggage rack or the floor, or unpacking items into provided furniture such as dressers and closets.

While these methods have been generally accepted, they are not without their shortcomings. Living out of a suitcase can often lead to disorganization and clutter, with guests frequently rummaging through their belongings to find specific items. On the other hand, unpacking into provided storage often seems unnecessary for short stays and can be time-consuming. Moreover, this approach assumes the availability and adequacy of storage space, which is not always the case, especially in smaller or more budget-oriented accommodations.

The current industry landscape of luggage storage furnishings primarily features static designs—standard dressers, closets, and luggage racks. These items, while functional, do not address the specific needs of the modern traveler, who may desire greater convenience and efficiency. The current offerings are often rigid in design, lacking the flexibility to accommodate different types and sizes of luggage, and do not consider the user experience of accessing belongings in a compact and organized manner. This gap in the market highlights a significant need for a storage solution that is specifically tailored to the needs of transient guests. There is a demand for a product that can accommodate luggage in a way that is accessible, efficient, and space-saving, without the need for unpacking into temporary storage spaces.

Common luggage storage solutions, such as foldable luggage racks or built-in closets and dressers, present several limitations. Luggage racks are often not robust enough to support heavier bags, and they do nothing to mitigate the clutter of an open suitcase. Built-in storage solutions like closets and dressers require guests to unpack, which is often seen as an unnecessary chore for short-term stays. Furthermore, the existing products rarely consider the ergonomic challenges associated with accessing items from a suitcase. Guests frequently need to bend or kneel to reach into a suitcase on the floor or luggage rack, which can be uncomfortable and inconvenient, especially for those with mobility issues.

In response to these challenges, it would be advantageous to provide a luggage storage berth device as a potential solution. Such a device may be advantageously designed to bridge the gap between convenience and functionality by offering a novel approach to luggage storage. Such a device may feature a system of drawers or compartments specifically sized to accommodate standard suitcases of many sizes, allowing guests to store their luggage in an easily accessible manner. The device addresses the need for efficient, organized, and ergonomic luggage storage without the requirement to unpack. Moreover, the luggage storage berth device offers flexibility in design, accommodating various sizes of luggage, and can be adapted to different room layouts and sizes. Its user-friendly approach not only enhances the guest experience but also streamlines the process of managing personal items, especially in temporary living situations.

Another pervasive and often overlooked issue in the design of traditional dressers, berths, and related furnishings is their susceptibility to tipping when heavy items are placed within drawers that are pulled open. This risk is particularly pronounced in environments where guests are likely to store heavy luggage, such as in hotels or vacation rentals. The standard design of most dresser units fails to adequately counterbalance the weight of fully loaded, extended drawers, posing a safety risk to users. This concern is heightened when considering the added weight and bulk of modern suitcases, which can significantly shift the center of gravity of these storage units.

The problem of tipping is not only a matter of safety but also impacts the usability and practicality of these furnishings. Many existing designs do not incorporate mechanisms to prevent the drawers from being pulled out too far or from bearing excessive weight. This oversight forces users to exercise undue caution when accessing their belongings, detracting from the convenience and ease of use that such storage solutions are meant to provide. In the context of transient accommodation settings, where guests are unfamiliar with the furniture, this risk is further accentuated, leading to potential accidents and liabilities for property owners.

Another critical aspect is that the majority of existing dressers and berths are not designed with the specific intention of housing luggage. Their dimensions and structural design are often ill-suited for the size and shape of standard luggage, leading to inefficient use of space and increased risk of tipping due to improper weight distribution. The lack of foresight in design to accommodate the unique requirements of luggage storage further underscores the inadequacy of current solutions in addressing the needs of travelers. Furthermore, the issue of stability is rarely addressed in a manner that is both effective and unobtrusive. While some furnishings may include basic anti-tipping hardware, these solutions often require permanent attachment to a wall or other structure, which may not be feasible or desirable in all settings, particularly in rental properties or temporary accommodations. This leads to a compromise between safety and flexibility, where neither is fully achieved.

Therefore, it would be advantageous to provide a luggage storage berth device that not only accommodates the storage of luggage associated with guests staying in transient housing accommodations, but also provides user-friendly means of preventing tipping of such a device when fully loaded and drawers are fully extended. Further, it would be advantageous to provide a luggage storage berth device that is structured to be robust when under full load by means of additional structural supports not found in existing furnishings. Generally, it would be advantageous to provide a practical and efficient luggage storage solution that could significantly improve the experience of staying in hotels, Airbnbs, or similar accommodations.

DETAILED DESCRIPTION OF THE INVENTION

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a luggage storage berth device" or any of its constituent parts also includes a plurality of luggage storage berth devices or any of its constituent parts and the like.

Figure 1:
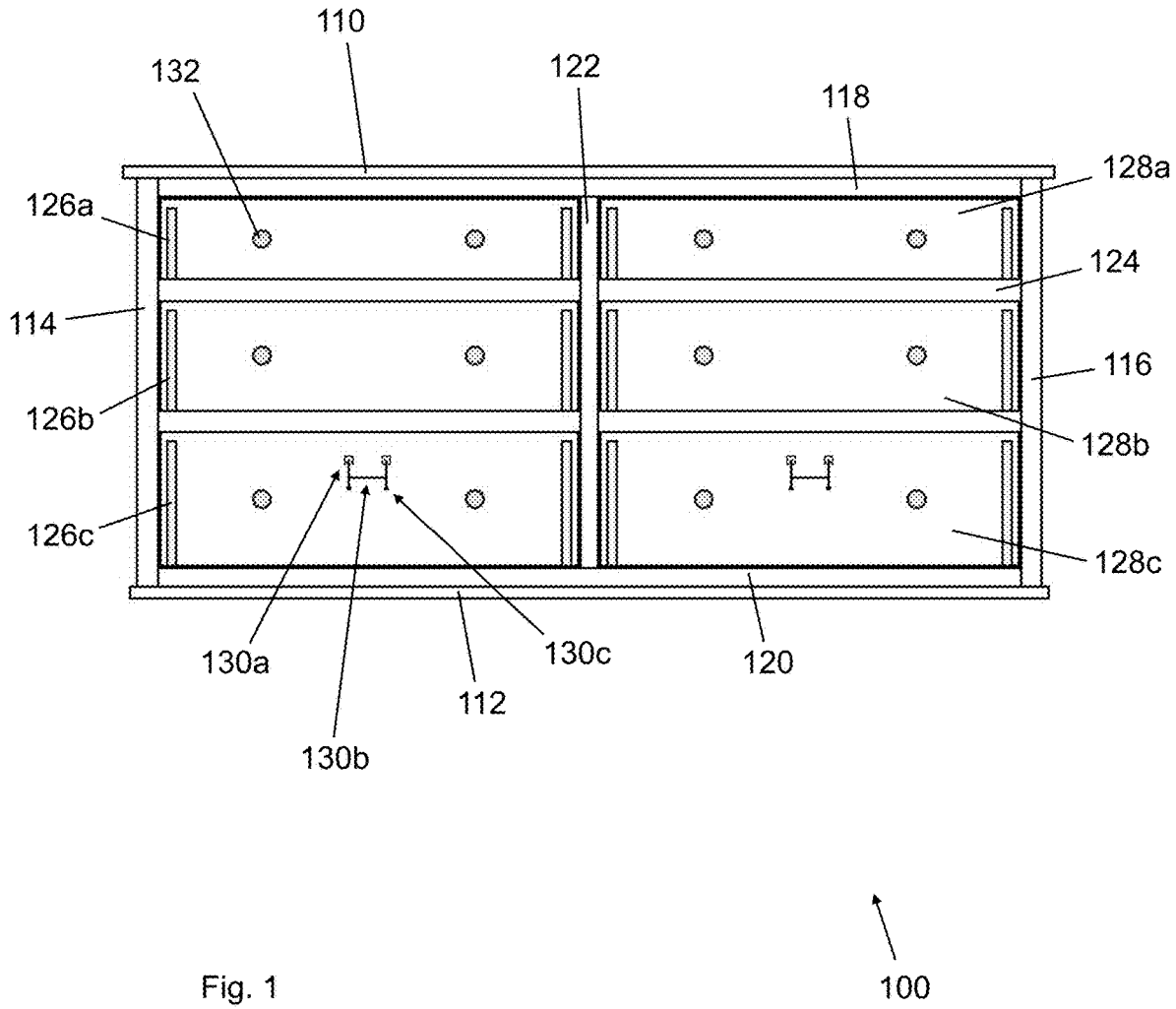
FIG. 1 illustrates an elevational front plan view of a luggage storage berth device showing a plurality of door panels in a stowed configuration in accordance with some embodiments of the present invention.

Exemplary embodiments of the present invention are illustrated in the accompanying figures. As shown in FIG. 1, an elevational front plan view of a luggage storage berth device 100 showing a plurality of sets of door panels 128*a*-128*c* in a stowed configuration is provided. The luggage storage berth device 100 may comprise a top support substrate 110, a bottom support substrate 112, a left support substrate 114 and a right support substrate 116. These support substrates 110, 112, 114, 116 may be stabilized via a top stabilization structure 118 and a bottom stabilization structure 120.

Further, each of the plurality of door panels 128*a*-128*c* may comprise a horizontal stabilization structure 124 disposed therebetween which themselves are coupled to a central stabilization structure 122. Each of the support substrates 110, 112, 114, 116 and the stabilization structures 118, 120, 122, 124 utilized in the luggage storage berth device 100, as exemplified in FIG. 1 of the accompanying drawings, is driven by the paramount need for robustness and stability in the context of accommodating large luggage weight loads. The top support substrate 110, bottom support substrate 112, and the left and right support substrates 114, 116, are designed to provide a strong, stable foundation and framework for the entire device. This foundation is essential for bearing the significant weight of fully packed suitcases, which can be considerably heavy.

The horizontal stabilization structures 124, positioned between the door panels, provide additional reinforcement, ensuring that the device maintains its shape and functionality even under the stress of heavy loads. These elements play a crucial role in distributing the weight of the luggage evenly across the device, thereby preventing any undue strain on individual components. Generally, the presence of these support substrates 110, 112, 114, 116 and stabilization structures 118, 120, 122, 124 ensures that the device can withstand the rigors of regular use in environments such as hotels and Airbnbs where luggage weight and frequency of use are variable and can be substantial.

Figure 2:
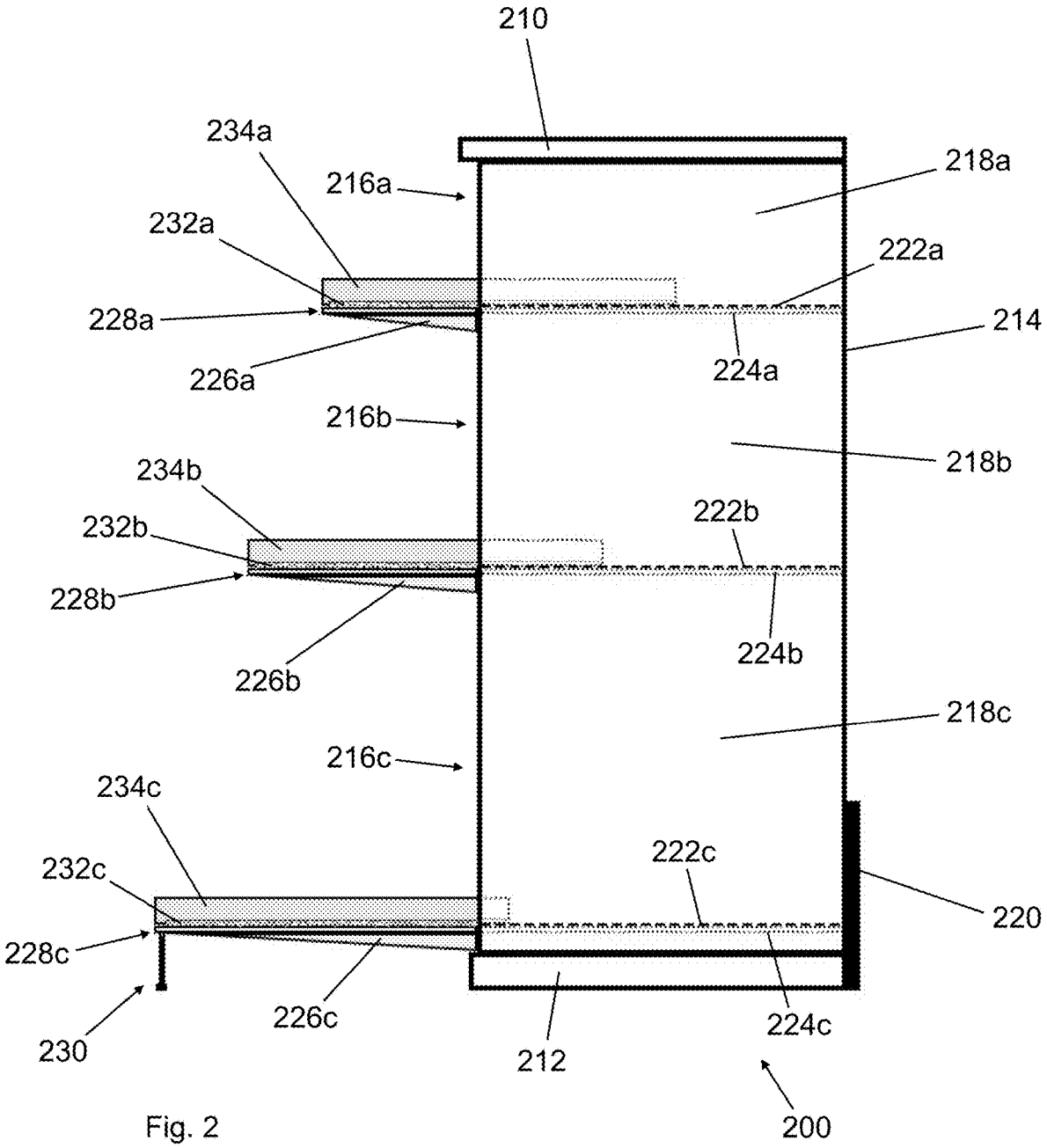
FIG. 2 illustrates an elevational side plan view of a luggage storage berth device showing a plurality of door panels in an extended configuration with a plurality of associated storage trays in an extended configuration in accordance with some embodiments of the present invention.

Additionally, each of the door panels 128*a*-128*c* may respectively comprise one or more rotational stop structures 126*a*-126*c*. For example, the door panel 128*a* in the first row and first column of the array of door panels may comprise a set of rotational stop structures 126*a* disposed at opposing ends of the lengthwise dimension of the door panel 128*a*. Providing at least one rotational stop structure 126*a* for the door panel 128*a* allows for stabilization of the door panel 128*a* when it is disposed in the extended configuration as illustrated in FIG. 2.

Moreover, each rotational stop structure of the plurality of rotational stop structures 126*a*-126*c* may be disposed at the bottommost vertical extent of the outer surface of the given door panel of the plurality of sets of door panels 128*a*-128*c*. Such a positional arrangement is advantageous in that it allows the rotational stop structure to prevent rotation of the given door panel beyond a 90 degree rotational angle range. This 90 degree rotational angle range defines the door panel iteratively transitioning between a stowed configuration (a zero degree rotational position) and an extended configuration (a 90 degree rotational position).

If the rotational stop structure were not disposed at the bottommost vertical extent of the outer surface of the door panel, then the door panel would be allowed to rotate beyond a 90 degree range which would structurally compromise the door panel when bearing heavy loads and further would not allow alignment of translational rail tracks for a storage tray to translate back and forth over. Therefore, the positional arrangement of the plurality of rotational stop structures 126*a*-126*c* is crucial to the functionality of the door panels 128*a*-128*c*.

Further, the rotational stop structures 126*a*-126*c* may be structured such that they also provide support to the door panels 128*a*-128*c* when in the extended configuration and supporting the storage trays thereupon and bearing a large weight load. Specifically, the rotational stop structures 126*a*-126*c* may comprise a triangular wedge shape which tapers from a larger thickness dimension to a smaller thickness dimension as the rotational stop structures 126*a*-126*c* extend from the bottommost vertical extent of the outer surface of the door panels 128*a*-128*c* to the topmost vertical extent thereof.

Thereby, when the door panels 128*a*-128*c* are disposed in the extended configuration (i.e. the 90 degree rotational position), the larger thickness dimensional portion of the rotational stop structures 126*a*-126*c* may be disposed directly adjacent the horizontal stabilization structures 124 or the bottom stabilization structure 120 while the smaller thickness dimensional portion of the structures 126*a*-126*c* may be disposed away from the horizontal stabilization structures 124 or the bottom stabilization structure 120 as shown in FIG. 2. Such a structural configuration provides robust load-bearing support for the door panels 128*a*-128*c* relative other structural configurations for the rotational stop structures 126*a*-126*c* such as a planar rectangular shape or a triangular wedge shape oriented in the opposite direction.

The door panels 128*c* disposed within the bottom row of panels in the array may comprise a handle support stand that is coupled to the door panels 128*c* via a pair of coupling mechanisms 130*a*. Specifically, the handle support stand may comprise a handle portion 130*b* and a support stand portion 130*c* that is coupled directly to the coupling mechanisms 130*a* via respective hinges. The support stand portion 130*c* may rotate relative the pair of coupling mechanisms 130*a* through a 90 degree rotational range between a stowed configuration and an extended configuration.

The handle portion 130*b* may be utilized by a user to pull the door panel 128*c* open and transition the handle support stand from the stowed configuration to the extended configuration. In doing so, the user may simultaneously transition the door panel 128*c* from the stowed configuration to the extended configuration. When the handle support stand and the door panel 128*c* are each in their extended configurations, the support stand portion 130*c* may be disposed adjacent a ground surface in order to provide additional support to the door panel 128*c* when a heavy weight load is disposed thereupon.

The handle support stand may advantageously only be utilized upon the bottom row door panel 128*c* in order to save material cost while accommodating the door panel 128*c* that is the dimensionally largest door panel that also extends out the furthest from the berth device 100. Thereby, the handle support stand provides needed support to bear the largest downward force when the largest luggage piece is disposed thereupon. The other door panels 128*a*, 128*b* may be transitioned between stowed and extended configurations by one or more gripping handles 132 which may take any suitable shape that allows for ease of grasping by the user.

As shown in FIG. 2, an elevational side plan view of a luggage storage berth device 200 showing a plurality of door panels 228*a*-228*c* in an extended configuration with a plurality of associated storage trays 234*a*-234*c* in an extended configuration is provided. The luggage storage berth device 200 may comprise a top support substrate 210 and a bottom support substrate 212. The top and bottom support substrates 210, 212 may be coupled together by an outer berth body 214 that surrounds in part each side of the luggage storage berth device 200.

The outer berth body 214 may comprise a plurality of openings 216*a*-216*c* disposed through a front surface of the body 214. Each of the openings 216*a*-216*c* may provide access to respective berth cavities 218*a*-218*c* as illustrated in FIG. 2. Each berth cavity 218*a*-218*c* may comprise a different volumetric value and may be shaped to accommodate associated sized luggage pieces. Specifically, each berth cavity 218*a*-218*c* may comprise successively larger volumetric values such that the top berth cavity 218*a* may comprise the smallest volumetric value and the bottom berth cavity 218*c* may comprise the largest volumetric values.

The design choice to provide successively larger volumetric values from the top berth cavity 218*a* to the bottom berth cavity 218*c* in the luggage storage berth device, as depicted in FIG. 2, offers significant advantages, particularly in terms of managing the center of mass and enhancing anti-tipping stability. By allocating the smallest volumetric value to the top cavity and progressively larger volumes towards the bottom, the device inherently encourages a lower center of gravity when loaded with luggage. This design is critical in mitigating the risk of the device tipping over, which is a prominent concern in traditional luggage storage solutions.

When larger, heavier luggage is placed in the lower cavities, especially the bottom berth cavity 218*c*, it ensures that the bulk of the weight is concentrated closer to the ground. This arrangement not only stabilizes the device but also makes it safer to use, as the heaviest items are stored in the lowest compartments, reducing the physical strain on users when accessing their luggage. Conversely, the smaller, likely lighter items are stored in the upper cavities, aligning with ergonomic principles for safe lifting and reducing the top-heavy nature of the device.

Furthermore, this progressive volumetric design accommodates a variety of luggage sizes, catering to the diverse needs of travelers. It allows for efficient space utilization within the device, ensuring that each compartment is optimally used without leaving excessive, unused space that could contribute to imbalanced weight distribution. This thoughtful approach to design not only improves the functional aspect of the luggage storage berth device 200 but also enhances user experience by providing a convenient, user-friendly, and safe storage solution.

Each of the berth cavities 218*a*-218*c* may be separated by respective shelf substrates 224*a*-224*c* upon which associated storage trays 234*a*-234*c* are disposed in full when the trays 234*a*-234*c* are in the stowed configuration and in part when the trays 234*a*-234*c* are in the extended configuration. Further, the storage trays 234*a*-234*c* may be allowed to successively extend out further from associated berth cavities 218*a*-218*c* from the top storage tray 234*a* to the bottom storage tray 234*c* such that the top storage tray 234*a* may extend out the least from the cavity 218*a* while the bottom storage tray 234*c* may extend out the most from the cavity 218*c* as illustrated in FIG. 2.

In the design of the luggage storage berth device, particularly as illustrated in FIG. 2, the feature of storage trays 234*a*-234*c* extending only partially when in use offers distinct advantages, especially in enhancing the device's stability and reducing the risk of tipping. Each of the berth cavities 218*a*-218*c* houses a storage tray, which is fully contained within the cavity in the stowed configuration but extends only partially in the extended configuration. This design choice is instrumental in maintaining a balanced distribution of weight within the device, particularly when the trays are laden with heavy luggage.

The partial extension of the storage trays ensures that a significant portion of the luggage's weight remains within the footprint of the outer berth body 214. By preventing the trays from fully extending out of the cavities, the center of gravity of the loaded device is kept closer to its base, thereby significantly reducing the likelihood of a forward tipping scenario. This is particularly crucial in environments where the device may be subject to uneven loading, such as in hotels or rental properties where guests might place heavy items in the trays.

Moreover, this design consideration aligns with the principles of ergonomic safety, as it discourages users from pulling the trays out to an extent where they could potentially cause the device to become unstable. It also ensures that users can access their belongings with ease, without having to reach excessively far or maneuver around fully extended trays, which could be cumbersome and potentially hazardous. In addition, the controlled extension of the trays contributes to the overall durability of the device. By limiting the extension distance, the stress on the rails and the structural integrity of the trays themselves is minimized, leading to a longer lifespan for these components and reduced maintenance requirements.

Each of the berth cavities 218*a*-218*c* may be separated by respective shelf support substrates 224*a*-224*c* which are fixed in place within the interior of the outer berth body 214 and are structured to support respective storage trays 234*a*-234*c* bearing load of associated luggage pieces. Additionally, the shelf support substrates 224*a*-224*c* may support respective interior rail tracks 222*a*-222*c* upon which the storage trays 234*a*-234*c* may translate along. Similarly, the door panels 228*a*-228*c* may support respective exterior rail tracks 232*a*-232*c* such that, when the panels 228-228*c* are disposed in the extended configuration, the exterior rail tracks 232*a*-232*c* are aligned with the interior rail tracks 222*a*-222*c*, thereby allowing the storage trays 234*a*-234*c* to translate across both interior and exterior rail tracks 222*a*-222*c*, 232*a*-232*c* between stowed and extended configurations.

In the extended configuration, the door panels 228*a*-228*c* may be supported by respective rotational stop structures 226*a*-226*c*. The rotational stop structures 226*a*-226*c* may be shaped as a triangular wedge shape and structurally positioned such that the thickest part of the wedge shape may be disposed directly adjacent the outer berth body 214, thereby preventing the door panels 228*a*-228*c* from rotating beyond a 90 degree rotational angle range from stowed configuration (a zero degree rotational position) to the extended configuration (a 90 degree rotational position).

This structural positioning of the triangular wedge shape of the rotational stop structures 226*a*-226*c* also facilitates optimal structural support of the respective door panels 228*a*-228*c* which enhances each panel's ability to support the storage trays 234*a*-234*c* under load of luggage pieces. In a similar manner, a handle support stand 230 may be coupled to the bottommost door panel 228*c* in order to provide stabilization and load-bearing capacity to the panel 228*c* given it is the panel that is allowed to extend out of its berth cavity 218*c* the farthest and also accommodates the largest luggage piece which results in the panel 228*c* having to support the largest static force being applied to it of each of the door panels. In order to prevent compromise of the structure associated with and adjacent to the door panel 228*c* as well as tipping of the entire berth device 200, the handle support stand 230 is advantageous to provide upon the door panel 228*c* but not upon the other door panels 228*a*, 228*b*.

In the context of the luggage storage berth device as shown in FIG. 2, the incorporation of a weighted rear base structure 220 on the rear lower portion of the outer berth body 214 is a significant design innovation, primarily aimed at enhancing the overall stability and safety of the device. This structure acts as a counterweight, strategically positioned to counterbalance the weight of luggage stored in the front-facing berth cavities. The advantage of such a design is twofold: it significantly reduces the risk of the device tipping forward when the drawers are fully extended and laden with heavy luggage, and it maintains a more stable and grounded stance for the device, irrespective of how the internal compartments are utilized.

The utilization of a weighted rear base structure is particularly advantageous in scenarios where users might unevenly load the front compartments, as it provides an inherent stabilizing force to counteract this uneven weight distribution. This design consideration is crucial in transient accommodation environments where users frequently access their luggage, potentially leading to shifting weight dynamics within the device. The weighted rear base structure 220 itself can take various forms such as, but not limited to, solid metal blocks or plates, sand-filled compartments, concrete or ceramic weights, fluid-filled bladders, removable weight modules and the like or any combinations thereof, each tailored to enhance stability while maintaining the aesthetic and functional integrity of the device 200.

In enhancing the safety features of the luggage storage berth device 200, particularly against the risk of tipping under heavy load conditions, the implementation of complementary anti-tipping brackets may be utilized. This approach may involve the strategic placement of one part of the bracket on the rear surface of the outer berth body 214 and the corresponding part on an adjacent wall surface. The term 'wall surface' encompasses in scope a floor surface or any other like static structural surface as well.

Further, both a wall and floor surface may be utilized in securing device 200. Moreover, a plurality of anti-tipping brackets may be advantageously disposed on a rear portion bottom surface, a bottom portion rear surface, a middle portion rear surface and/or a top portion rear surface of the outer berth body 214 of the device 200. Preferably, the brackets may be placed at a rear portion of the bottom surface of the body 214 in order to forego potential damage to a fragile wall surface where no stud is disposed while using a floor surface which is much more robust to rotational torque being applied to it by an otherwise-tipping device 200.

If a floor surface is not utilized to removably anchor the device 200, then it would preferable to utilize the brackets at a top portion rear surface of the body 214 in order to provide maximum torque-bearing capacity from the wall surface, whereas brackets disposed at a bottom portion rear surface would apply a higher torque to the wall surface from an otherwise-tipping device 200 and would increase the risk of wall damage and, further, danger from tipping of the device 200 after the wall structure is compromised and gives out. When coupled together, these brackets form a secure connection between the berth device 200 and the wall, significantly mitigating the risk of the device tipping forward when its drawers are extended and loaded.

The bracket on the rear surface of the berth device would be an integral part of its structure, designed to be both strong and unobtrusive. This bracket may be a metal plate or bar, securely affixed to the device 200, with pre-drilled holes or slots for ease of alignment and attachment. The corresponding wall bracket may be a similar metal component, designed to be mounted onto the wall at a height that aligns with the bracket on the device. The design of these brackets may provide a flush and secure fit against the wall, minimizing any gap between the device and the wall for maximum stability.

For installation, the process may involve positioning the berth device 200 at the desired location, marking the wall where the bracket aligns, and then securely fixing the wall bracket in place using appropriate wall anchors or screws, depending on the wall material (such as drywall, brick, or concrete). Once the wall bracket is installed, the berth device can be slid into place, and the two brackets can be coupled together, typically using screws or bolts. This coupling mechanism may be designed for easy engagement and disengagement, allowing for the device 200 to be moved if necessary, while still providing a strong and reliable anti-tipping mechanism when in use.

The anti-tipping brackets designed for the luggage storage berth device 200 are conceptualized to provide robust resistance against unintended decoupling, while still facilitating easy disengagement by the user when required. The following structural shapes and designs for these brackets may be utilized. Interlocking J-hooks may be designed in a 'J' shape having an extended top arm on the device that interlocks with a corresponding shorter arm on the wall bracket. The natural weight of the device keeps the hooks engaged, but they can be easily separated by a slight upward lift and outward slide of the device. Sliding channel brackets may utilize a channel bracket on the wall and a matching sliding bracket on the device, this design allows horizontal sliding engagement.

The device's bracket includes a stopper or locking pin for secure attachment, which can be manually disengaged for removal. Bolt and slot brackets may incorporate a slot on the device's bracket and a bolt on the wall bracket, this design allows for vertical alignment and sliding engagement. A nut or fastener is used post-engagement to prevent accidental detachment, which can be unscrewed for decoupling. Keyhole brackets may utilize a combination of a circular hole and an attached downward slot on the device bracket, and a corresponding protruding screw or peg on the wall bracket, this design ensures a secure fit. The device is mounted by aligning and sliding down so the screw fits into the slot, locking the device in place.

In order to further minimize the occurrence of tipping of the luggage storage berth device 200, it would be advantageous that the door panels 228*a*, 228*b*, 228*c* are sized such that each panel gets a larger height dimension the further down the device 200 the panel is while the width and depth dimensions remain equal. Therefore, panel 228*a* has the smallest height dimension, panel 228*b* has the second smallest height dimension, and panel 228*c* has the largest height dimension. The decreasing height of the panels 228*a*-228*c* dictates the degree to which the respective storage trays 234*a*-234*c* are allowed to extend out into their respective extended configurations, which creates a center of gravity that is less likely to tip when the trays are under load. Therefore, the degree to which each of the trays 234*a*-234*c* are allowed to extend outward from respective berth cavities 218*a*-218*c* increases the further down the device 200 the tray is.

In the luggage storage berth device 200, as detailed in FIG. 2, the sizing and proportional height dimensions of the door panels 228*a*-228*c* are ingeniously tailored to optimize the center of gravity and minimize the risk of tipping. The design incorporates a gradation in the height dimensions of these panels, with panel 228*a* having the smallest height, panel 228*b* the second smallest, and panel 228*c* the largest. This gradation directly influences the extent to which the corresponding storage trays 234*a*-234*c* can extend out from their berth cavities 218*a*-218*c*, thereby controlling the center of gravity when the trays are under load.

To maintain a stable center of gravity while ensuring sufficient access to the contents, the following proportional range is proposed for the height differential between the door panels: the height of panel 228*a* may be set as a baseline (e.g., X inches). Panel 228*b* may be 10-20% taller than panel 228*a*, and panel 228*c*, the lowest, may be 20-30% taller than panel 228*b*. This incremental increase in height allows lower trays, which can bear heavier loads, to extend further, thus maintaining stability.

Correspondingly, the lateral extension of the storage trays needs to be proportionate to their position within the device. The tray at the top, 234*a*, should extend the least, ensuring the center of gravity remains as low as possible when it is under load. The middle tray, 234*b*, can extend moderately further, while the bottom tray, 234*c*, can extend the most. A practical range for this proportional extension would be as follows: the extension of tray 234*a* may be set as a baseline (e.g., Y inches). Tray 234*b* may extend 10-20% further than tray 234*a*, and tray 234*c* may extend 20-30% further than tray 234*b*.

These proposed ranges strike a balance between stability and user accessibility. By incrementally increasing the height of the panels and correspondingly the extension of the trays downwards, the device effectively manages the distribution of weight, keeping the center of gravity lower, especially when handling heavy luggage. This approach not only enhances the overall safety of the luggage storage berth device but also ensures that users can comfortably access their luggage without compromising the device's stability.

Figure 3:
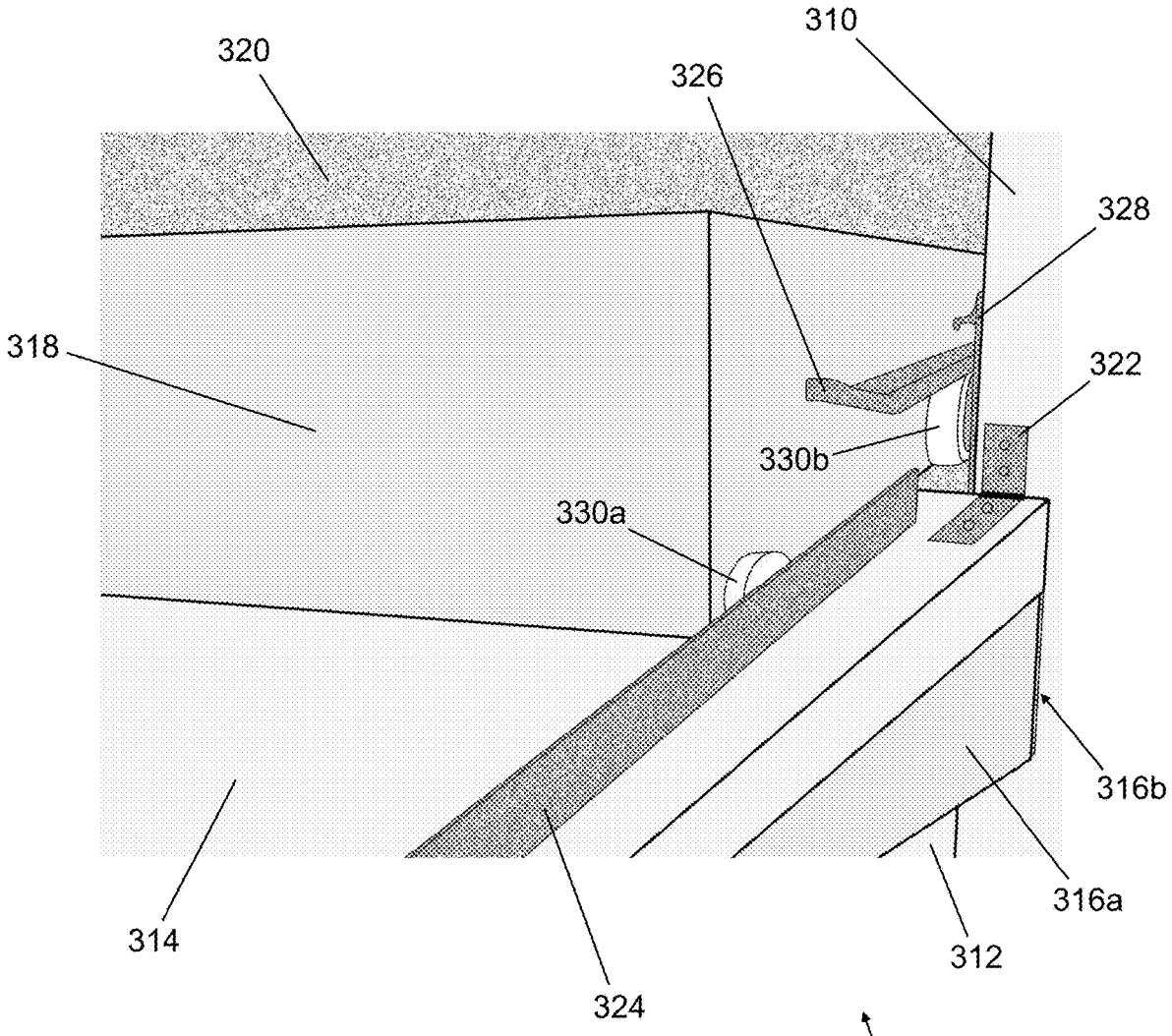
FIG. 3 illustrates a perspective view of a storage tray transitioning between a stowed configuration and an extended configuration via an interior rail track within a berth cavity and an exterior rail track disposed upon a door panel of a luggage storage berth device in accordance with some embodiments of the present invention.

As shown in FIG. 3, a perspective view of a storage tray 318 transitioning between a stowed configuration and an extended configuration via an interior rail track 328 within a berth cavity 320 and an exterior rail track 324 disposed upon a door panel 314 of a luggage storage berth device 300 is provided. The luggage storage berth device 300 may comprise a side stabilization structure 310 coupled to a horizontal stabilization structure 312. The side stabilization structure 310 may support a door panel 314 via a rotational hinge 322 which allows the door panel 314 to rotate within a 90 degree angle range from a stowed configuration (a zero degree angle range) to an extended configuration (a 90 degree angle range).

The door panel 314 may be prevented from rotating past the 90 degree threshold via a rotational stop structure 316*a* which abuts the side stabilization structure 310 at the 90 degree rotational position. In this position, a deformable buffer layer 316*b* may be disposed over the surface of the rotational stop structure 316*a* abutting the side stabilization structure 310 which prevents abrasion between the stop structure 316*a* and the stabilization structure 310 as a result of iterative abutment between the two. The rotational stop structure 316*a* is illustrated as advantageously having a triangular wedge shape in order to provide optimal relative force for supporting heavy loads while minimizing material cost and providing an aesthetically appealing structure on the exterior of the luggage storage berth device 300.

The storage tray 318 may translate between the stowed and extended configurations via the interior rail track 328, the exterior rail track 324, and an alignment rail track 326. The interior rail track 328 may be coupled to an inside surface of the stabilization structure 310 within the berth cavity 320. The exterior rail track 324 may be disposed upon an inside surface of the door panel 314. The alignment rail track 326 may be coupled to an outer surface of the body of the storage tray 318 such that the track 326 translates along a drawer roller slide 330*b* so as to serve as an alignment mechanism between the exterior and interior rail tracks 324, 328. The storage tray 318 may translate along the rail tracks 324, 328 via drawer roller slides 330*a*, 330*b*.

However, the storage tray 318 may not be allowed to translate along the rail tracks 324, 328 when the door panel 318 is in the stowed configuration. Specifically, when the door panel 318 is in the stowed configuration, the exterior rail track 324 may be arranged in an orthogonal orientation relative the alignment rail track 326 and the interior rail track 328. Therefore, in such a configuration, the rail tracks 324, 326, 328 are not arranged in a parallel orientation and so the storage tray 318 cannot translate along the rail tracks 324, 328. When the door panel 318 is in the extended configuration, the exterior rail track 324 may be arranged in a parallel orientation relative the alignment rail track 326 and the interior rail track 328. Therefore, the storage tray 318 may only be allowed to translate along the rail tracks 324, 328 when the exterior rail track 324 is disposed in parallel with the alignment rail track 326 and the interior rail track 328 as illustrated in FIG. 3.

Figure 4:
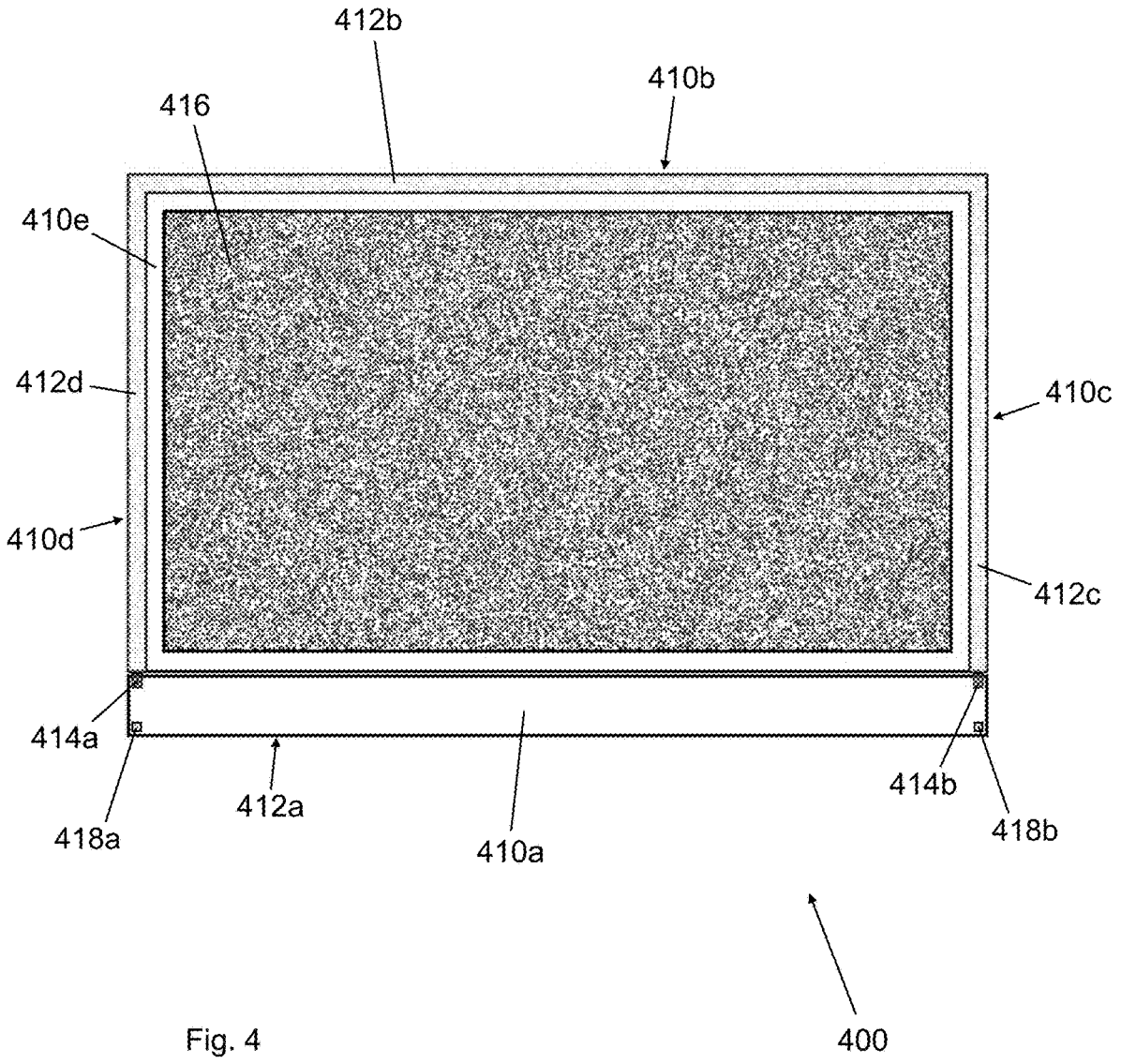
FIG. 4 illustrates a top plan view of a storage tray of a luggage storage berth device with a front panel in an extended configuration in accordance with some embodiments of the present invention.

As shown in FIG. 4, a top plan view of a storage tray 400 of a luggage storage berth device with a front panel 410*a* in an extended configuration is provided. The storage tray 400 may comprise a front panel 410*a*, a rear panel 410*b*, a right panel 410*c*, a left panel 410*d* and a floor panel 410*e*. Further each of the front, rear, right and left panels 410*a*-410*d* may comprise respective planar top surfaces 412*a*-412*d* which may each comprise a lamination layer or other low-friction coating disposed thereover in order to allow users to easily drag luggage pieces across the top surfaces 412*a*-412*d* without getting snagged upon or dragging across the surfaces which may lead to structural compromise of the storage tray 400 or the luggage storage berth device more generally, particularly when dealing with heavy luggage pieces.

The storage tray 400 of the luggage storage berth device may comprise the floor panel 410*e* equipped with a non-slip material layer 416 disposed thereover. This non-slip layer plays a crucial role in preventing luggage from sliding across the floor panel 410*e* of the tray 400 which provides several structural and material advantages. The non-slip material layer 416, which may be composed of materials such as rubber, silicone, or textured plastics, provides a high-friction surface that grips the luggage piece. This grip is essential for maintaining the stability of the luggage when the tray is being pulled out or pushed in, particularly important in a transit accommodation environment where guests frequently access their belongings.

By mitigating the movement of luggage within the tray, the non-slip layer reduces the risk of dynamic shifts in weight, which could otherwise lead to instability or tipping of the overall device. Additionally, the choice of a non-slip layer serves to protect both the luggage and the storage tray itself. It cushions the contact between the luggage and the tray, minimizing scratches, dents, or other damage to both the luggage and the interior of the tray. This protective layer extends the lifespan of the storage tray 400 by reducing the wear and tear that can occur from repeated use, particularly with heavy luggage items.

Furthermore, the non-slip material layer 416 also enhances the user experience. It prevents the luggage from unintentionally moving or sliding out when the tray is opened, making it easier for users to access their items without having to rearrange or re-stabilize their luggage while also being able to move the storage tray 400 between stowed and extended configurations by simply pulling and pushing on the luggage piece itself. This thoughtful design consideration contributes to a more convenient, stress-free interaction with the device. Therefore, the incorporation of a non-slip material layer 416 over the floor panel 410*e* of the storage tray 400 in the luggage storage berth device represents a deliberate approach to improve safety, protect the integrity of both luggage and the device, and enhance user convenience, especially in the context of handling heavy luggage pieces.

The luggage storage berth device may utilize fold-down functionality for the front panel 410*a*, facilitated by rotational hinges 414*a* and 414*b*, to provide significant advantages, particularly for the topmost storage tray 400. This design feature allows the front panel 410*a* to rotate 90 degrees downwards into a parallel configuration with the floor panel 410*e*, offering enhanced accessibility and ease in the placement and removal of luggage pieces, especially heavy ones.

When dealing with storage trays 400 positioned at a higher level within the berth device, the fold-down mechanism becomes increasingly beneficial. For heavy luggage pieces, lifting and maneuvering into a confined space between the peripheral panels 410*a*-410*d* and over the top surface 412*a*-412*d* can be both physically challenging and awkward for users which places them in physical danger. The ability to lower the front panel 410*a* to align with the floor panel 410*e* creates an extended, flat surface that significantly eases this process. Users can slide luggage in and out of the tray 400 smoothly, without the need for lifting over a barrier, which is particularly advantageous for those with limited strength or mobility or when handling large or awkwardly-shaped luggage pieces.

This fold-down feature also reduces the risk of injury and strain associated with lifting heavy luggage at an awkward angle, especially when using the topmost tray 400. By converting the front panel 410*a* into an extension of the floor panel 410*e*, the device accommodates a more natural and ergonomically favorable movement for loading and unloading luggage. Furthermore, the rotational hinges 414*a* and 414*b* are designed to provide a sturdy and reliable connection, ensuring that the front panel 410*a* can securely support the weight of the luggage as it is being slid in or out. This stability is crucial, as it prevents any accidental collapse or tipping of the panel during use, maintaining the overall integrity and safety of the device.

Building upon the fold-down functionality of the front panel 410*a* in the luggage storage berth device, the utilization of coupling mechanisms 418*a* and 418*b* aligned with the rotational hinges 414*a* and 414*b* enable the front panel 410*a* to be securely attached to or detached from the front portion of the left and right panels 410*c*, 410*d*. This feature facilitates a seamless transition of the front panel 410*a* between its stowed and extended configurations, adding versatility to the storage tray 400.

The coupling mechanisms 418*a* and 418*b*, which may be implemented as magnetic couplings or other similar non-permanent iterative coupling mechanism, are designed to provide a straightforward and reliable method for users to modify the position of the front panel 410*a*. When the panel 410*a* is in the stowed configuration, these mechanisms 418*a*, 418*b* lock the panel 410*a* in place, ensuring that it remains secure and stable when not in use. This locked position is crucial for maintaining the structural integrity of the tray 400, particularly when it is loaded with luggage.

In contrast, when users need to access the contents of the tray 400, especially heavy luggage in the uppermost compartments, the coupling mechanisms 418*a*, 418*b* allow for a quick and effortless detachment of the front panel 410*a*. This detachment enables the panel 410*a* to rotate downwards, aligning with the floor panel 410*e* and thereby creating an extended, flat loading surface. This flexibility is particularly beneficial when handling bulky or heavy items, as it minimizes physical exertion and the risk of strain or injury.

Moreover, the iterative nature of the coupling and decoupling process ensures that users can easily switch between configurations as needed, without the requirement for tools or excessive force. The design of the coupling mechanisms is intuitive, allowing even first-time users to operate them with ease, thereby enhancing the overall user experience. More generally, the incorporation of coupling mechanisms 418*a* and 418*b* in the luggage storage berth device provides a significant functional advantage. It allows for a user-friendly and adaptable interface with the front panel 410*a*, facilitating easy access to luggage, especially in the higher compartments, and contributing to the device's ergonomic and practical design.

Figure 5A:
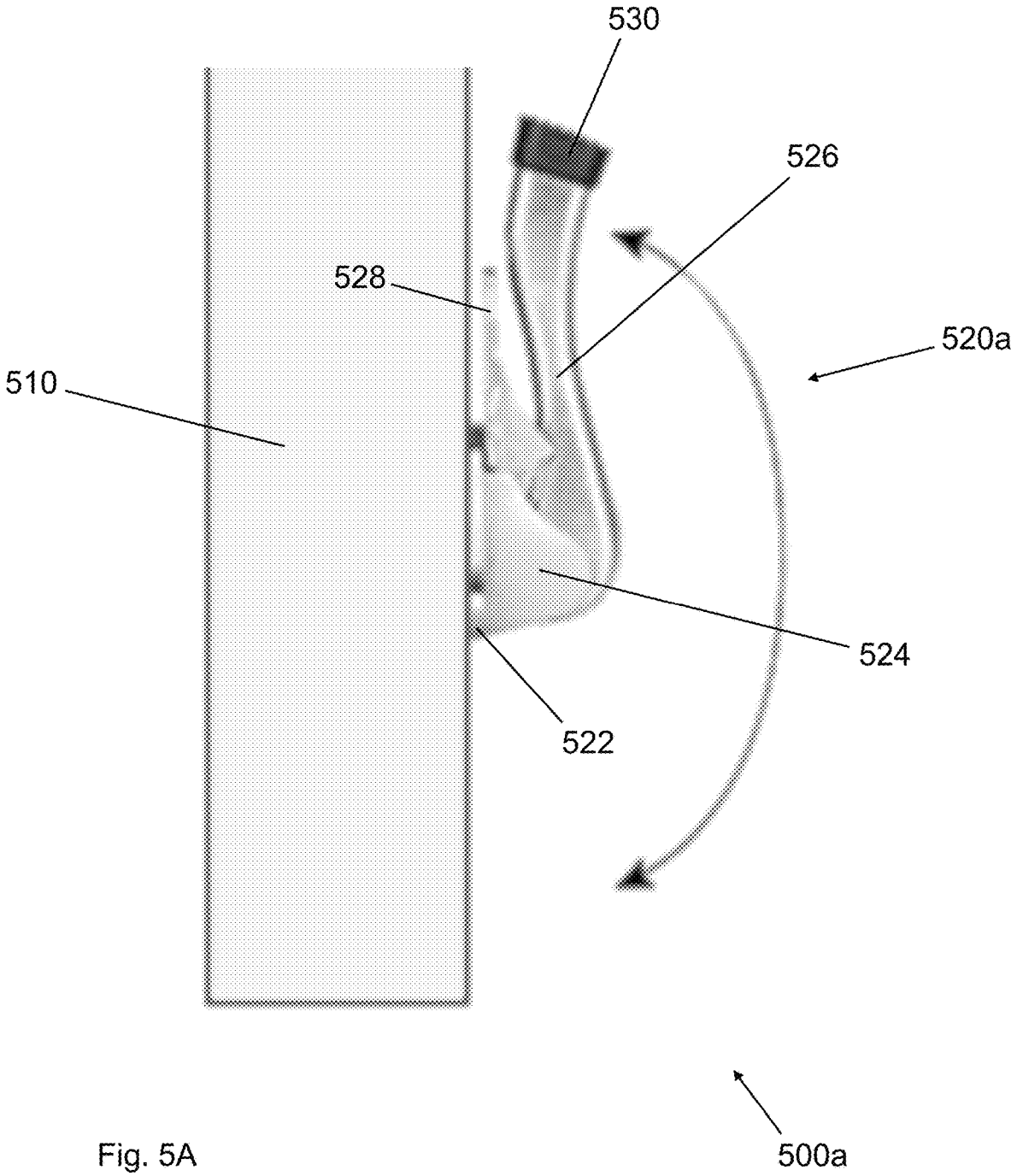
FIG. 5A illustrates an elevational side view of an anti-tipping structure in a stowed configuration and attached to an exterior surface of a luggage storage berth device in accordance with some embodiments of the present invention.

As shown in FIG. 5A, an elevational side view of an anti-tipping structure 500*a* in a stowed configuration 520*a* and attached to an exterior surface of a luggage storage berth device 510 is provided. The anti-tipping structure 500*a* may comprise a coupling mechanism 522 that attaches the structure 500*a* to the exterior surface of the luggage storage berth device 510. Further, a rotational support hinge 524 extends from the coupling mechanism 522 and allows the remaining structural components of the anti-tipping structure 500*a* to rotate thereabout, specifically an elongate support member 526, a manipulation mechanism 528, and a floor surface gripping stopper 530.

The elongate support member 526 may extend from the rotational support hinge 524 at a proximal end thereof and may comprise the manipulation mechanism 528 also at the proximal end as shown in FIG. 5A. The manipulation mechanism 528 may be utilized by a user to more easily manipulate the anti-tipping structure 500*a* between stowed and extended configurations with a user's foot since the structure 500*a* is intended to be disposed at a bottom portion of the berth device 510 adjacent a floor surface. The floor surface gripping stopper 530 may extend from a distal end of the elongate support member 526 in order to abut the ground surface at an angle relative the berth device 510 in order to assist in preventing the tipping of the berth device 510 when in use under heavy load.

Figure 5B:
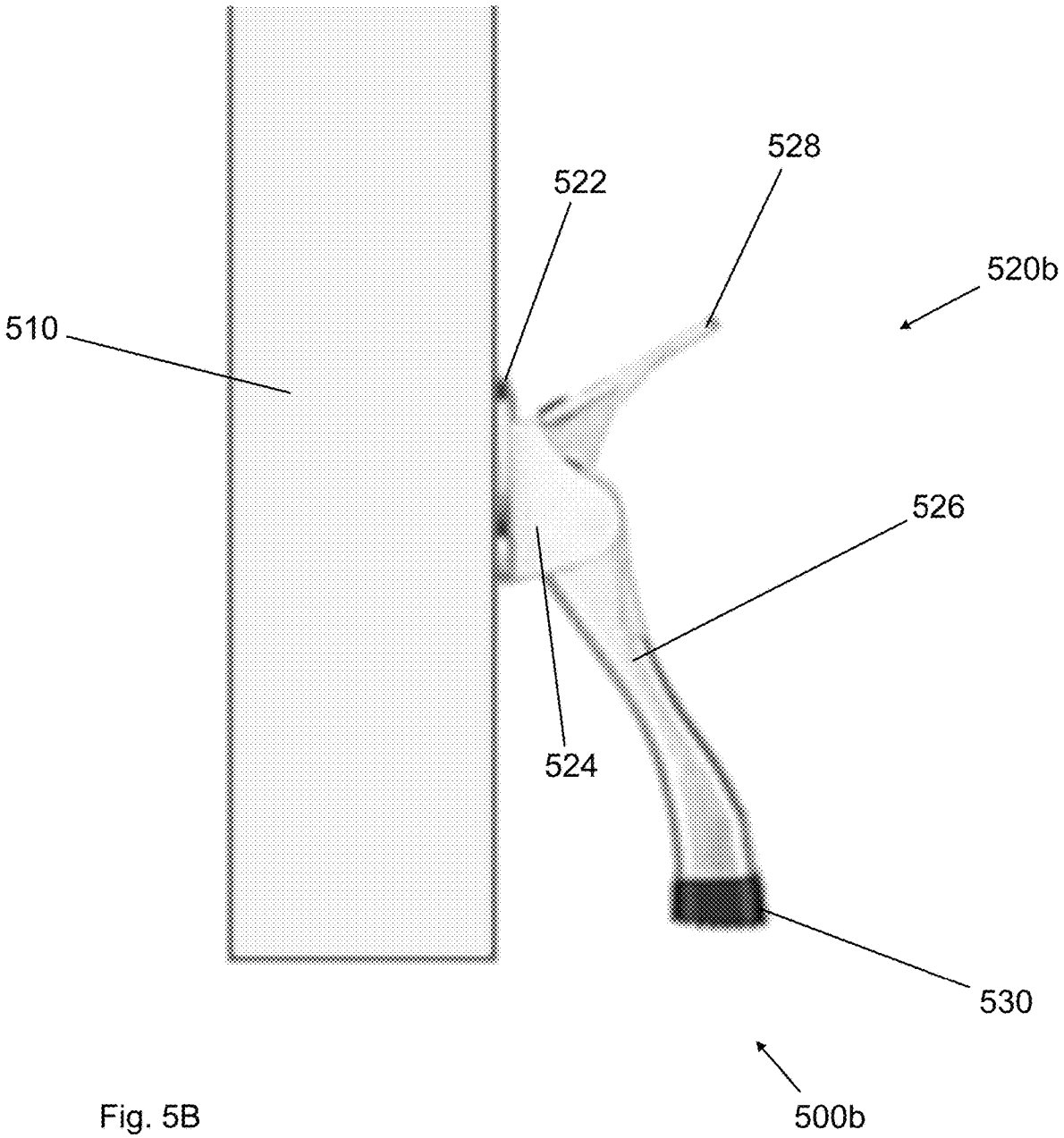
FIG. 5B illustrates an elevational side view of an anti-tipping structure in an extended configuration and attached to an exterior surface of a luggage storage berth device in accordance with some embodiments of the present invention.

As shown in FIG. 5B, an elevational side view of an anti-tipping structure 500*b* in an extended configuration 520*b* and attached to an exterior surface of a luggage storage berth device 510 is provided. When deployed in the extended configuration 520*b*, this structure 500*b* effectively abuts the ground surface, creating a counterbalancing force that significantly reduces the risk of the berth device 510 tipping over, especially under heavy loads. The extended configuration 520*b*, achieved through the user interaction with the manipulation mechanism 528, is aimed at enhancing the stability of the luggage storage berth device 510.

The elongate support member 526, pivotal in this configuration, extends from the rotational support hinge 524 located at its proximal end. This member 526 projects outward from the base of the berth device 510, reaching an optimal length and angle to effectively interact with the ground surface. The distal end of this member is equipped with a floor surface gripping stopper 530, which plays a vital role in anchoring the device 510. This stopper, designed to maximize ground contact and friction, ensures that the anti-tipping structure 500*b* firmly grips the floor, providing a stable and reliable base even when the storage trays of the berth device 510 are fully extended and laden with heavy luggage.

Regarding optimal length and angle, and in the context of a luggage storage berth device 510 designed with dimensions comparable to a standard dresser furnishings, the optimal length and angle of the anti-tipping structure, particularly when deployed to prevent tipping under heavy load, are critical for ensuring safety and stability. Considering the typical height, depth, and width of a standard dresser, the elongate support member of the anti-tipping structure 500*b* should extend to a length that provides sufficient leverage to counterbalance the weight of fully loaded and extended storage trays.

For a dresser of average dimensions, an elongate support member 526 extending approximately 12 to 18 inches (30 to 45 cm) from the base of the device 510 would be effective. This range accommodates variations in dresser size while ensuring enough ground contact to stabilize the device 510. The angle of deployment relative to the vertical axis of the berth device 510 is another crucial factor. An angle ranging from 25 to 45 degrees with respect to the ground surface is recommended. This angle range provides a balanced approach, ensuring that the anti-tipping structure 500*b* does not extend too far, which could create a tripping hazard, nor too little, which would be ineffective in preventing tipping.

Furthermore, the chosen length and angle should align with the typical load expected in a standard dresser-like luggage storage device 510. For instance, if the device 510 is expected to hold heavier luggage, the longer end of the length range and the steeper end of the angle range would be more suitable to provide enhanced stability. The design should also consider the floor type on which the device will be placed, ensuring that the floor surface gripping stopper 530 is compatible with both carpeted and hard floor surfaces for optimal traction.

The manipulation mechanism 528, situated at the proximal end of the elongate support member 526, is designed for foot operation by the user, enabling the user to deploy or retract the anti-tipping structure 500*b* without the need to bend down or use their hands, adding an ergonomic advantage to the design. This ease of operation is especially beneficial in scenarios where quick adjustment is needed, like in hotel or Airbnb settings, or where different guests might have varying luggage weights and sizes.

The extended configuration of the anti-tipping structure 500*b*, as illustrated in FIG. 5B, not only enhances the stability of the luggage storage berth device 510 but also instills confidence in users. It addresses the common concern of furniture tipping, providing a practical solution that ensures the safety of users and the integrity of the stored items. This design consideration demonstrates a deep understanding of user needs and the dynamic challenges posed by heavy luggage storage, making the luggage storage berth device 510 a more reliable and user-friendly option in transient living environments.

Figure 6:
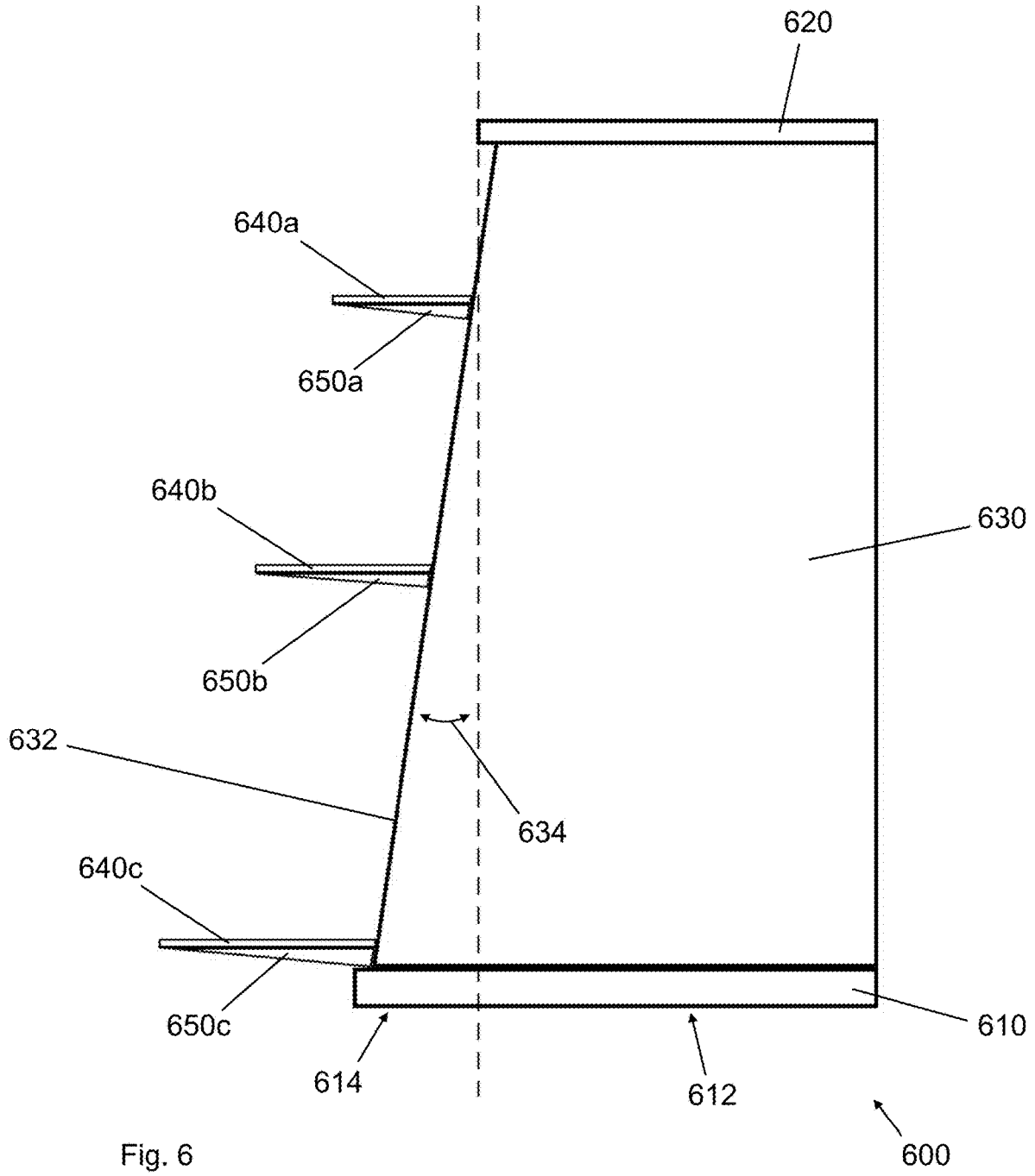
FIG. 6 illustrates an elevational side view of a luggage storage berth device having an enhanced center of gravity bottom support substrate in accordance with some embodiments of the present invention.

As shown in FIG. 6, an elevational side view of a luggage storage berth device 600 having an enhanced center of gravity bottom support substrate 610 is provided. The luggage storage berth device 600 may comprise the enhanced center of gravity bottom support substrate 610 and a top support substrate 620 with a berth body 630 disposed therebetween. The bottom support substrate 610 comprises a proximal portion 612 that is equal in length to the top support substrate 620 and a distal portion 614 that extends beyond the length of the top support substrate 620 as shown. The distal portion 614 of the bottom support substrate 610 provides a wider base for the berth device 600, an enhanced center of gravity, and a larger required rotational force to tip the berth device 600.

Consequently, the berth body 630 comprises a tapered front surface 632 that tapers outward toward the bottom support substrate 610. Therefore, the angle 634 formed by the outward taper may be added onto the rotational angle range that the door panels 640*a*-640*c* may rotate within. Specifically, the panels 640*a*-640*c* may comprise the 90 degree rotational angle range as discussed in previous embodiments of the present invention plus the taper angle 634 to define a larger rotational angle range of the panels 640*a*-640*c*. This also requires that the rotational stop structures 650*a*-650*c* have an altered shape to accommodate for the tapered front surface 632. Specifically, instead of utilizing a right angle triangular wedge shape as discussed in previous embodiments of the present invention, the rotational stop structures 650*a*-650*c* may comprise an acute angled triangular wedge shape where the acute angle is defined by 90 degrees minus the taper angle 634.

This taper angle 634, formed by the tapered front surface 632 of the berth body 630, plays a significant role in enhancing the anti-tipping capabilities of the device 600 while balancing material costs and maintaining an efficient form factor. The taper angle 634, by extending outward toward the bottom support substrate 610, provides an increased base width, contributing to a lower and more stable center of gravity and demanding a larger rotational force to tip the device 600.

An advantageous range for the taper angle 634 would be between 5 to 15 degrees. This range has been determined to effectively augment the anti-tipping capabilities of the berth device without significantly increasing material costs or altering the device's form factor in a manner that would be aesthetically or functionally undesirable. At a lower end of this range (around 5 degrees), the taper provides a subtle but effective extension to the base, improving stability without drastically changing the device's appearance or requiring a substantial increase in material usage. At the higher end (up to 15 degrees), the taper becomes more pronounced, offering even greater stability and a bolder design statement, yet still remaining within practical limits for material use and manufacturing.

Furthermore, this taper angle 634 range allows the door panels 640*a*-640*c* to possess an increased rotational angle range. The taper angle 634 adds onto the standard 90-degree rotational range of the panels, thus permitting a wider opening and easier access to the contents within. This adaptation also necessitates a redesign of the rotational stop structures 650*a*-650*c* to accommodate the acute angled triangular wedge shape, aligning with the new dynamics introduced by the tapered front surface 632. Generally, this angle range balances the need for a stable and user-friendly design with considerations of material efficiency and manufacturing practicality.

In some embodiments of FIGS. 1-6, a luggage storage berth device is provided comprising: a top support substrate and a bottom support substrate; a plurality of horizontal stabilization structures disposed between the top and bottom support substrates; a plurality of vertical stabilization structures disposed between the top and bottom support substrates; an outer berth body disposed between the top and bottom support substrates; a plurality of berth cavities defined in part by each of the top support substrate, the bottom support substrate, the plurality of horizontal stabilization structures, the plurality of vertical stabilization structures, and the outer berth body; a plurality of storage trays, wherein: each storage tray is disposed within a respective berth cavity, each storage tray translates between a stowed configuration and an extended configuration, in the extended configuration, each storage tray is disposed through a respective opening within the outer berth body, in the stowed configuration, each storage tray is disposed within the respective berth cavity, and each storage tray translates along a plurality of rail tracks via a plurality of roller slides.

In some embodiments of FIGS. 1-6, each of the plurality of berth cavities is separated by respective shelf substrates, the shelf substrates are disposed within the outer berth body, the top support substrate extends in a horizontal dimension beyond each of the shelf substrates, and the bottom support substrate extends in a horizontal dimension beyond each of the shelf substrates.

In some embodiments of FIGS. 1-6, the top support substrate extends in a horizontal dimension beyond the outer berth body, the bottom support substrate extends in a horizontal dimension beyond the outer berth body, each of the plurality of rail tracks are disposed adjacent a plurality of shelf substrates, and the plurality of shelf substrates are disposed at least in part within the outer berth body, In some embodiments of FIGS. 1-6, each opening within the outer berth body is arranged in an array, the array comprises at least two columns, the array comprises at least two rows, the openings within each row are separated by at least one central stabilization structure, and the openings within each column are separated by at least one horizontal stabilization structure.

In some embodiments of FIGS. 1-6, each opening within the other berth body is covered by a respective door panel, the outer berth body comprises one or more anti-tipping structures, the outer berth body comprises one or more weighed rear base structures, the bottom support substrate comprises one or more anti-tipping structures, and the bottom support substrate comprises one or more weighed rear base structures.

In some embodiments of FIGS. 1-6, a luggage storage berth device is provided comprising: a top support substrate and a bottom support substrate; a plurality of horizontal stabilization structures disposed between the top and bottom support substrates; a plurality of vertical stabilization structures disposed between the top and bottom support substrates; an outer berth body disposed between the top and bottom support substrates; a plurality of berth cavities defined in part by each of the top support substrate, the bottom support substrate, the plurality of horizontal stabilization structures, the plurality of vertical stabilization structures, and the outer berth body; a plurality of storage trays, wherein: each storage tray is disposed within a respective berth cavity, each storage tray translates between a stowed configuration and an extended configuration, in the extended configuration, each storage tray is disposed through a respective opening within the outer berth body, in the stowed configuration, each storage tray is disposed within the respective berth cavity, and each storage tray translates along a plurality of rail tracks via a plurality of roller slides; and a plurality of door panels, wherein: each of the plurality of door panels covers one of the openings within the outer berth body, each of the plurality of door panels is removable from covering one of the openings within the outer berth body, and each of the plurality of door panels rotates away from one of the openings within the outer berth body within an angle range of at least 90 degrees.

In some embodiments of FIGS. 1-6, a luggage storage berth device is provided, comprising: a top support substrate and a bottom support substrate; a plurality of horizontal stabilization structures disposed between the top and bottom support substrates; a plurality of vertical stabilization structures disposed between the top and bottom support substrates; an outer berth body disposed between the top and bottom support substrates; a plurality of berth cavities defined in part by each of the top support substrate, the bottom support substrate, the plurality of horizontal stabilization structures, the plurality of vertical stabilization structures, and the outer berth body; a plurality of storage trays, wherein: each storage tray is disposed within a respective berth cavity, each storage tray translates between a stowed configuration and an extended configuration, in the extended configuration, each storage tray is disposed through a respective opening within the outer berth body, in the stowed configuration, each storage tray is disposed within the respective berth cavity, and each storage tray translates along a plurality of rail tracks via a plurality of roller slides;

the bottom support substrate comprises a horizontal width dimension differential relative the top support substrate; and the outer berth body comprises a front tapered surface that tapers outward from the top support substrate towards the bottom support substrate, wherein: the outward taper is defined by a taper angle that is directly proportional to the horizontal width dimension differential, each of the openings is disposed within the front tapered surface, and each of the openings increases in surface area the closer the openings are disposed to the bottom support substrate.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A luggage storage berth device, comprising:

a top support substrate and a bottom support substrate;

a plurality of horizontal stabilization structures disposed between the top and bottom support substrates;

a plurality of vertical stabilization structures disposed between the top and bottom support substrates;

an outer berth body disposed between the top and bottom support substrates;

a plurality of berth cavities defined in part by each of the top support substrate, the bottom support substrate, the plurality of horizontal stabilization structures, the plurality of vertical stabilization structures, and the outer berth body;

a plurality of storage trays, wherein:

each storage tray comprises a plurality of peripheral panels disposed upon a floor panel, each of the plurality of peripheral panels comprise a height dimension and a width dimension, the height and width dimension of each of the plurality of peripheral panels is smaller than a width dimension of the floor panel, the plurality of peripheral panels comprises a front panel having a length dimension equal to the width dimension of the floor panel, the plurality of peripheral panels comprises a left panel and a right panel, the front panel rotatably relative the left and right panels via first and second rotational hinges, the first and second rotational hinges each comprises a first hinge portion rotatably coupled to a second hinge portion, each said first hinge portion is non-rotatably coupled to a first end portion of a first coupling surface of the front panel, the second hinge portion rotates no more than 90 degrees relative the first hinge portion, the front panel rotates no more than 90 degrees relative the left and right panels and, when the front panel rotates 90 degrees relative the left and right panels, the front panel is disposed in parallel with the floor panel, the front panel further comprises a plurality of coupling mechanisms disposed on a second end portion of the first coupling surface opposite the first end portion of the first coupling surface, each said storage tray is disposed within one said berth cavity, each said storage tray translates between a stowed configuration and an extended configuration, in the extended configuration, each said storage tray is disposed through an opening within the outer berth body, in the stowed configuration, each said storage tray is disposed within the berth cavity, each said storage tray translates along a plurality of rail tracks via a plurality of roller slides, the plurality of rail tracks comprise an alignment rail track and an interior rail track, the alignment rail track comprises a vertical dimension smaller than that of the interior rail track, and the alignment rail track is fully disposed within the vertical dimension of the interior rail track.

2. The luggage storage berth device of claim 1, wherein each of the plurality of berth cavities is separated by shelf substrates.

3. The luggage storage berth device of claim 2, wherein the shelf substrates are disposed within the outer berth body.

4. The luggage storage berth device of claim 2, wherein the top support substrate extends in a horizontal dimension beyond each of the shelf substrates.

5. The luggage storage berth device of claim 2, wherein the bottom support substrate extends in a horizontal dimension beyond each of the shelf substrates.

6. The luggage storage berth device of claim 1, wherein the top support substrate extends in a horizontal dimension beyond the outer berth body.

7. The luggage storage berth device of claim 1, wherein the bottom support substrate extends in a horizontal dimension beyond the outer berth body.

8. The luggage storage berth device of claim 1, wherein:

each of the plurality of rail tracks are disposed adjacent a plurality of shelf substrates, and the plurality of shelf substrates are disposed at least in part within the outer berth body.

9. The luggage storage berth device of claim 1, wherein each said opening within the outer berth body is arranged in an array.

10. The luggage storage berth device of claim 9, wherein the array comprises at least two columns.

11. The luggage storage berth device of claim 10, wherein the array comprises at least two rows.

12. The luggage storage berth device of claim 11, wherein the openings within each said row are separated by at least one central stabilization structure.

13. The luggage storage berth device of claim 12, wherein the openings within each said column are separated by at least one said horizontal stabilization structure.

14. The luggage storage berth device of claim 1, wherein each said opening within the other berth body is covered by a door panel.

15. The luggage storage berth device of claim 1, wherein the outer berth body comprises one or more weighted rear base structures.

16. The luggage storage berth device of claim 1, wherein the bottom support substrate comprises one or more weighted rear base structures.

17. A luggage storage berth device, comprising:

a top support substrate and a bottom support substrate;

a plurality of horizontal stabilization structures disposed between the top and bottom support substrates;

a plurality of vertical stabilization structures disposed between the top and bottom support substrates;

an outer berth body disposed between the top and bottom support substrates;

a plurality of berth cavities defined in part by each of the top support substrate, the bottom support substrate, the plurality of horizontal stabilization structures, the plurality of vertical stabilization structures, and the outer berth body;

a plurality of storage trays, wherein:

each said storage tray is disposed within one said berth cavity, each said storage tray translates between a stowed configuration and an extended configuration, in the extended configuration, each said storage tray is disposed through an opening within the outer berth body, in the stowed configuration, each said storage tray is disposed within the berth cavity, each said storage tray translates along a plurality of rail tracks via a plurality of roller slides, the plurality of rail tracks comprise an alignment rail track and an interior rail track, the alignment rail track comprises a vertical dimension smaller than that of the interior rail track, and the alignment rail track is fully disposed within the vertical dimension of the interior rail track;

a plurality of door panels, wherein:

each of the plurality of door panels covers one of the openings within the outer berth body, each of the plurality of door panels is removable from covering one of the openings within the outer berth body, each of the plurality of door panels rotates away from one of the openings within the outer berth body within an angle range of at least 90 degrees, a first door panel of the plurality of door panels comprises a first height value, a second door panel of the plurality of door panels comprises a second height value, and a third door panel of the plurality of door panels comprises a third height value, the first door panel is disposed vertically above the second door panel and the second door panel is disposed vertically above the third door panel, the second height value is 10-20% larger than the first height value and the third height value is 20-30% larger than the second height value, and each of the plurality of door panels comprises two rotational stop structures disposed at opposing horizontal ends of each of the plurality of door panels; and an anti-tipping bracket disposed on a top portion of a rear surface of the outer berth body, wherein the anti-tipping bracket interlocks with a wall bracket disposed on a wall surface.

18. A luggage storage berth device, comprising:

a top support substrate and a bottom support substrate;

a plurality of horizontal stabilization structures disposed between the top and bottom support substrates;

a plurality of vertical stabilization structures disposed between the top and bottom support substrates;

an outer berth body disposed between the top and bottom support substrates;

a plurality of berth cavities defined in part by each of the top support substrate, the bottom support substrate, the plurality of horizontal stabilization structures, the plurality of vertical stabilization structures, and the outer berth body;

a plurality of storage trays, wherein:

each said storage tray is disposed within one said berth cavity, each said storage tray translates between a stowed configuration and an extended configuration, in the extended configuration, each said storage tray is disposed through an opening within the outer berth body, in the stowed configuration, each said storage tray is disposed within the berth cavity, each said storage tray translates along a plurality of rail tracks via a plurality of roller slides, the plurality of rail tracks comprise an alignment rail track and an interior rail track, the alignment rail track comprises a vertical dimension smaller than that of the interior rail track, and the alignment rail track is fully disposed within the vertical dimension of the interior rail track;

the bottom support substrate comprises a horizontal width dimension differential relative the top support substrate; and the outer berth body comprises a front tapered surface that tapers outward from the top support substrate towards the bottom support substrate, wherein:

the outward taper is defined by a taper angle that is directly proportional to the horizontal width dimension differential, a value of the taper angle is between 5 and 15 degrees, a first distance value a first storage tray of the plurality of storage trays translates into the extended configuration is smaller than a second distance value a second storage tray of the plurality of storage trays translates into the extended configuration, the first storage tray disposed vertically above the second storage tray, the first distance value and the second distance value are each directly proportional to the value of the taper angle, each of the openings is disposed within the front tapered surface, and each of the openings increases in surface area the closer the openings are disposed to the bottom support substrate.

19. The luggage storage berth device of claim 1, wherein:

a first storage tray of the plurality of storage trays translates a first distance value into the extended configuration, a second storage tray of the plurality of storage trays translates a second distance value into the extended configuration, and a third storage tray of the plurality of storage trays translates a third distance value into the extended configuration, the first storage tray is disposed vertically above the second storage tray and the second storage tray is disposed vertically above the third storage tray, and the second distance value is 10-20% larger than the first distance value and the third distance value is 20-30% larger than the second distance value.

20. The luggage storage berth device of claim 1, further comprising:

a plurality of door panels, wherein:

each of the plurality of door panels covers one of the openings within the outer berth body, each of the plurality of door panels is removable from covering one of the openings within the outer berth body, each of the plurality of door panels rotates away from one of the openings within the outer berth body within an angle range of at least 90 degrees, a first door panel of the plurality of door panels comprises a first height value, a second door panel of the plurality of door panels comprises a second height value, and a third door panel of the plurality of door panels comprises a third height value, the first door panel is disposed vertically above the second door panel and the second door panel is disposed vertically above the third door panel, the second height value is 10-20% larger than the first height value and the third height value is 20-30% larger than the second height value, and the third door panel comprises a handle support stand on an outer surface of the third door panel disposed away from the outer berth body.

* * * * *